United States Patent [19]

Chenevey et al.

[11] Patent Number: 4,606,875

[45] **Date of Patent: * Aug. 19, 1986**

[54] PROCESS FOR PREPARING SHAPED ARTICLES OF RIGID ROD HETEROCYCLIC LIQUID CRYSTALLINE POLYMERS

[75] Inventors: Edward C. Chenevey, North Plainfield, N.J.; Thaddeus E. Helminiak, Dayton, Ohio

[73] Assignee: Celanese Corporation, New York, N.Y.

[ * ] Notice: The portion of the term of this patent subsequent to Dec. 11, 2001 has been disclaimed.

[21] Appl. No.: 483,798

[22] Filed: Apr. 11, 1983

[51] Int. Cl.[4] ..... D01D 5/06; D01F 6/74

[52] U.S. Cl. ..... 264/85; 264/184; 264/210.4; 264/331.12; 528/183; 528/185; 528/337

[58] Field of Search ..... 264/184, 331.12, 85, 264/210.4; 528/337, 185, 183, 351

[56] References Cited

U.S. PATENT DOCUMENTS

| | | | |
|---|---|---|---|
| 3,313,783 | 4/1967 | Iwakura et al. | 528/337 |
| 3,574,170 | 4/1971 | Chenevey | 264/184 |
| 4,051,108 | 9/1971 | Helminiak et al. | 528/185 |
| 4,054,633 | 10/1977 | Richardson | 528/337 |
| 4,148,774 | 4/1979 | Silver | 528/185 |
| 4,225,700 | 9/1980 | Wolfe et al. | 528/337 |
| 4,377,546 | 3/1983 | Helminiak et al. | 264/108 |
| 4,423,202 | 12/1983 | Choe | 528/377 |

*Primary Examiner*—Jeffery Thurlow

*Attorney, Agent, or Firm*—Burns, Doane, Swecker & Mathis

[57] ABSTRACT

Shaped articles are prepared from rigid rod heterocyclic liquid crystalline polymers. The articles are prepared by polymerizing the polymer in a reaction medium whereby a solution of the polymer is formed and by forming the articles directly from the polymer solution.

15 Claims, No Drawings

PROCESS FOR PREPARING SHAPED ARTICLES OF RIGID ROD HETEROCYCLIC LIQUID CRYSTALLINE POLYMERS

BACKGROUND OF THE INVENTION

1. Field of the Invention

This invention relates to a process for preparing shaped articles of rigid rod heterocyclic liquid crystalline polymers.

2. Description of the Prior Art

The preparation of shaped articles, such as fibers, filaments, yarns, and films composed of polybenzothiazoles is known in the art. In U.S. Pat. No. 3,681,297, a selected dialdehyde is reacted with a defined aromatic bismercaptoamine to obtain a polybenzothiazoline. This material is then subjected to oxidation to obtain the related polybenzothiazole. In the event that unconverted reactants remain, the patent discloses that the polymer may be heated in excess of 175° C., preferably in the range of 250°–400° C. in nitrogen or 250°–350° C. in air to cause chain extending polymerization.

In U.S. Pat. No. 4,051,108, two-dimensional microscopic sheets or coatings are formed by initially dissolving a formed para ordered aromatic heterocyclic polymer in a polymer solution such as methanesulfonic acid. The polymer solution is added to a non-solvent for the polymer thereby causing the polymer to precipitate. The polymer particles are collected by filtration, such as by using a fritted glass filter, or by dipping an object in the dispersion. Evaporation of the solvent can be accelerated by employing a forced air oven. A similar technique is described in U.S. Pat. No. 3,987,015.

In U.S. Pat. No. 3,313,783, high molecular weight polybenzimidazoles are prepared by reacting at least one inorganic acid salt of an aromatic tetra-primary amine and at least one dicarboxylic acid or derivative thereof in a polyphosphoric acid medium at an elevated temperature in the range of from 100° to 250° C.

In U.S. Pat. No. 4,225,700, poly [benzo(1,2-d:4,5-d')bisthiazole-2,6-diyl]-1,4-phenylene is prepared by reacting 2,5-diamino-1,4-benzenedithiol dihydrochloride with terephthalic acid in polyphosphoric acid. The polymerization mixture is precipitated into water and successively washed with water, dilute ammonium hydroxide and then water. Alternatively, the mixture is combined with methanesulfonic acid, precipitated into methanol and successively washed with water, aqueous ammonium hydroxide and methanol and then freeze dried from benzene.

In U.S. Pat. No. 3,574,170, poly(bisbenzimidazobenzophenanthroline) is prepared by reacting at least one organic tetra-amine with at least one tetracarboxylic acid or its corresponding dianhydride. The patent refers to a concurrently filed U.S. application Ser. No. 867,880 (now abandoned), which application describes a process for preparing shaped articles of the specified polymer by direct extrusion of the polymerization medium into a coagulation bath. Similarly, wholly aromatic carbocyclic polycarbonamide shaped articles may be prepared from the polymerization medium as disclosed, for example, in U.S. Pat. No. 3,819,587.

No prior art of which applicants are aware discloses or suggests that shaped articles of rigid rod heterocyclic liquid crystalline polymers, particularly poly [benzo(1,2-d:4,5-d')bisthiazole-2,6-diyl]-1,4-phenylene may be prepared directly from the reaction mixture.

In application Ser. No. 483,799 now U.S. Pat. No. 4,554,119 issued Nov. 19, 1985 filed concurrently herewith by Edward C. Chenevey, entitled "Process for Heat Treating Shaped Articles of Poly [benzo(1,2-d:4,5-d')bisthiazole-2,6-diyl]-1,4-phenylene, Its Cis Isomer or Mixtures Thereof and the Articles Formed Thereby" and assigned to an assignee of the present application, there is described a process for simultaneously heating and stretching shaped articles of the defined polymer.

In application Ser. No. 483,797 now U.S. Pat. No. 4,487,735, issued Dec. 11, 1984 filed concurrently herewith by Edward C. Chenevey and Ronald Kafchinski, entitled "Process for Preparing Film of Poly [benzo(1,2-d:4,5-d')bisthiazole-2,6-diyl]-1,4-phenylene, Its Cis Isomer or Mixtures Thereof" and assigned to an assignee of the present application, there is described a process for preparing film of the polymer by extruding it on a casting roll, subjecting it to elevated temperatures and, preferably, heat treating it.

OBJECTS AND SUMMARY OF THE INVENTION

Accordingly, it is a general object of the present invention to provide a novel process for preparing shaped articles of rigid rod heterocyclic liquid crystalline polymers.

It is another object of the present invention to provide a novel process for preparing shaped articles of rigid rod heterocyclic liquid crystalline polymers which enables the articles to be prepared at reduced cost and process complexity.

It is a further object of the present invention to provide a novel process which results in shaped articles having a higher degree of molecular orientation and strength when compared to articles prepared under the same conditions, but which also undergo precipitation and dissolution steps.

It is a further object of the present invention to provide a novel process for preparing shaped articles of a rigid rod heterocyclic liquid crystalline polymer selected from the group consisting of poly [benzo(1,2-d:4,5-d')bisthiazole-2,6-diyl]-1,4-phenylene (both cis and trans isomers); poly(p-phenylene benzobisimidazole) (cis isomer only); and poly(p-phenylene benzobisoxazole) (both cis and trans isomers).

It is a still further object of the present invention to provide a novel process for preparing shaped articles of a rigid rod heterocylic liquid crystalline polymer which requires a single solvent recovery step and is thus an advance over prior art processes which required two solvent recovery steps and large volumes of wash liquor.

In one aspect, the present invention provides a process for preparing shaped articles of a rigid rod heterocyclic liquid crystalline polymer. The process comprises:

(a) forming a reaction mixture comprising reactants for the formation of said polymer and a reaction medium selected from the group consisting of polyphosphoric acid, dehydrating phosphate acids and mixtures thereof.

(b) polymerizing the reactants in the reaction mixture whereby a solution of said polymer is formed; and (c) forming shaped articles directly from the polymer solution.

In another aspect, the present invention provides a process for preparing shaped articles of a rigid rod heterocyclic liquid crystalline polymer. The process comprises:

(a) forming a reaction mixture comprising reactants for the formation of a polymer selected from the group consisting of poly [benzo(1,2-d:4,5-d')bisthiazole-2,6-diyl]-1,4-phenylene and its cis isomer, poly(p-phenylene benzobisimidazole), poly(p-phenylene benzobisoxazole) and its trans isomer and mixtures thereof and a reaction medium selected from the group consisting of polyphosphoric acid, dehydrating phosphate acids and mixtures thereof.

(b) polymerizing the reactants in the reaction mixture whereby a solution of said polymer is formed; and (c) forming shaped articles directly from the polymer solution.

These and other objects, as well as the scope, nature and utilization of the invention will be apparent from the following summary and detailed description of the present invention.

DESCRIPTION OF THE PREFERRED EMBODIMENTS

As stated hereinabove, the present invention relates to a process for preparing shaped articles of rigid rod heterocyclic liquid crystalline polymers. In the environment of the present invention, the term "shaped articles" refers to fibers, filaments, yarns, films and other articles amenable to preparation by the present invention.

The polymers of the present invention are rigid rod (due to the configuration of the polymer chain) which exhibit liquid crystalline (i.e., anisotropic) properties when in solution. The polymers are characterized by high thermo-oxidative resistance and high tensile strength and modulus which may be employed as a substitute for fiber reinforced composite in such environments as aerospace vehicles.

Exemplary of the rigid rod heterocyclic liquid crystalline polymers of the present invention are those selected from the group consisting of:

(I) poly [benzo(1,2-d:4,5-d')bisthiazole-2,6-diyl]-1,4-phenylene, its cis isomer or mixtures thereof (hereinafter collectively referred to as "PBT") having the repeating unit:

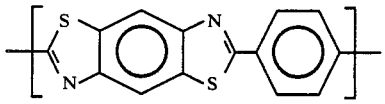

and/or

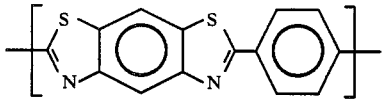

(II) poly(p-phenylene benzobisoxazole), its trans isomer or mixtures thereof (hereinafter collectively referred to as "PBO") having the repeating unit:

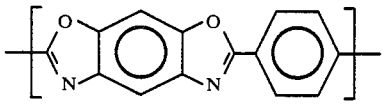

and/or

-continued

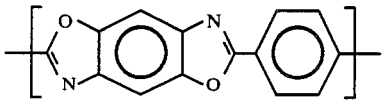

(III) poly(p-phenylene benzobisimidazole) (hereinafter referred to as "PBI") having the repeating unit:

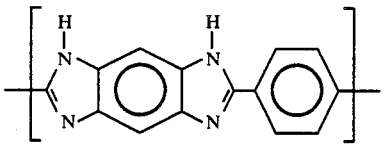

(IV) mixtures of (I) to (III).

Of course, as should be understood by those of ordinary skill in the art, the available hydrogen atoms on the aromatic rings may be substituted with halogen atoms and short chain alkyl and alkoxy groups which do not substantially adversely affect the characteristics of the polymer. The formal names, the abbreviations and the described recurring units are to be understood as encompassing such polymers consistent with this understanding.

In accordance with the present invention, the reactants for the formation of the polymer are formed into a reaction mixture which comprises the reactants and a reaction medium which is selected from the group consisting of polyphosphoric acid, dehydrating phosphate acids, such as phosphorous trioxide and phosphorous pentoxide, and mixtures thereof. The reactants which are used are those which yield the polymers under the reaction conditions of the present invention. Thus, for example, the unsubstituted trans isomer of PBT may be formed by reacting terephthalic acid with 2,5-diamino-1,4-benzenedithiol dihydrochloride. Similarly, the unsubstituted cis and trans isomers of PBO may be respectively formed by reacting terephthalic acid with 4,6-diamino resorcino dihydrochloride and by reacting terephthalic acid with 3,6-diamino hydroquinone dihydrochloride. PBI may be formed by reacting terephthalic acid with 1,2,4,5-tetraamino benzenetetrahydrochloride. Of course, alternate reactants, such as other acid salts, may similarly be employed to yield the polymers.

The reaction media are available commercially, but may also be synthesized. Thus, for example, polyphosphoric acid may be prepared by reacting phosphorus pentoxide with orthophosphoric acid. A more complete discussion of this procedure is set forth in U.S. Pat. No. 3,313,783, the content of which is incorporated by reference.

The amount of reactants in the reaction mixture will naturally vary depending on such variables as the specific reactants and reaction medium. However, the amount of reactants will typically range from about 3 to about 20%, preferably from about 5 to about 18% by weight of the reaction mixture.

The polymerization reaction is conducted at a temperature in the range of from about 150° to about 220° C., preferably from about 170° to about 200° C. Although the process may be conducted under atmospheric conditions, the reaction is preferably conducted in the substantial absence of oxygen. That is, the reaction is preferably performed in a substantially inert atmosphere at approximately atmospheric pressure, preferably from about 720 to about 800 mm. Hg. Suitable materials include nitrogen, helium, argon, neon, krypton, carbon dioxide, and mixtures thereof with nitrogen being preferred.

The reaction proceeds until the intrinsic viscosity of the polymer is between about 10 and about 30 dl./g., preferably between about 20 and about 30 dl./g. Polymers having an intrinsic viscosity of less than about 10 dl./g. exhibit poor strength properties. It will be readily understood that the reaction time to obtain substantially complete polymerization will vary depending on the reaction conditions. However, the reaction will typically require from about 6 to about 24 hours. Stirring at the beginning of the reaction is preferred to ensure an intimate, uniform mixture. However, as the reaction proceeds and viscosity increases, stirring becomes increasingly difficult.

After polymerization has been completed, the solution of the polymer in the remnants of the reaction mixture is directly formed into the shaped article. At this time, the polymer comprises from about 5 to about 18% by weight of the solution. Direct formation of the article may be accomplished through known techniques such as wet spinning or more preferably dry jet wet spinning which will impart orientation to the article prior to coagulation. Spinning is typically performed at a temperature in the range of from about 0° to about 180° C., and a pressure in the range of from about 100 to about 10000 p.s.i.g. The coagulation bath may be comprised of water, aqueous phosphoric acid, methanol or a methanol-phosphoric acid mixture. After the shaped article is prepared, residual solvent may be washed from the article in a fresh water or methanol rinse and the article dried.

As stated above, the present invention represents a substantial advance in the art inasmuch as the elimination of the need for a second solvent along with the additional use and recovery of wash liquor creates a significant saving in capital and operational expense while yielding exceptional results. The properties of the shaped article are superior to those of the shaped article which is prepared in an identical process, but which is formed from a polymer that is also precipitated and dissolved in a solvent prior to forming the article. This is believed to be at least in part caused by the ability of the polyphosphoric acid and/or dehydrating phosphate acids to inhibit polymer chain entanglement after polymerization is completed. The polymer-containing reaction mixture, which is an extensible plastic dope even at higher solids contents, can be formed into the article such that orientation of the polymer chains occur. Exemplary of such techniques is the use of an air gap up to about 10 cm. and very high spin-draw ratios, such as up to 18:1 or even higher. Depending on the specific polymer and the manner of preparation and shaping, the formed articles may typically possess a tenacity in the range of from about 3 to about 20 g./den. and a modulus in the range of from about 300 to about 1500 g./den. The properties of the shaped article may be further improved in accordance with inventions disclosed and claimed in aforementioned concurrently filed application Ser. Nos. 483,797 and 483,799, now U.S. Pat. Nos. 4,487,735 and 4,554,119 respectively.

In contrast to the present invention, if the reaction mixture is first precipitated, the polymer chains become entangled. Dissolution of the polymer in an appropriate solvent does not restore the polymer chains to their pre-precipitation condition and a lower degree of molecular orientation and tensile strength results.

To obtain a more complete understanding of the present invention, the following examples of forming the polymer and preparing shaped articles are set forth. It should be understood, however, that the invention is not limited to the specific details set forth therein:

EXAMPLE 1

A mixture containing equimolar amounts of 2,5-diamino-1,4-benzenedithiol hydrochloride and terephthalic acid in polyphosphoric acid is permitted to react thereby yielding a reaction mixture having an intrinsic viscosity of 31 dl./g. and a solids level of 5.6%. The reaction mixture is extruded using a 5 hole 200 μm jet. The mixture is spun with an air gap of 7.6 cm. into a coagulant bath containing 9% phosphoric acid/91% water. The temperature of the dope is 60° C. and a spin-draw ratio of 3.7 is employed. The resulting properties are: Denier/Tenacity/Elongation/Modulus=10.9/18.0/6.9/480. In this form, Tenacity and Modulus are in grams/denier and Elongation is in %.

EXAMPLE 2

A similar PBT reaction mixture in polyphosphoric acid having an intrinsic viscosity of 14 dl./g. and a solids level of 9.2% is formed. The mixture extruded from a 20 hole 133 μm hole size jet with a 10 cm. air gap into a coagulant bath containing 10% phosphoric acid/90% water using a spin-draw ratio of 4.3, the properties obtained after washing and drying are: Denier/Tenacity/Elongation/Modulus=6.3/12.1/3.4/810.

EXAMPLE 3

Extrusion of a similar PBT reaction mixture in polyphosphoric acid containing 9.2% solids and having an intrinsic viscosity of 14 dl./g. is performed using a 0.5 inch wide die with a gap of 0.007 in. and a spin-draw ratio of 9. The film is coagulated in an aqueous bath and the process thus yields a film with a dry width of 4.5 mm., a denier of 440, a tenacity of 9.5 g./den., an elongation of 3.3% and a modulus of 720 g./den.

Although the invention has been described with preferred embodiments, it is to be understood that variations and modifications may be resorted to as will be apparent to those skilled in this art. Such variations are to be considered within the scope of the following claims.

We claim:

1. A process for preparing shaped articles of a rigid rod heterocyclic liquid crystalline polymer comprising:

(a) forming a reaction mixture comprising reactants for the formation of a polymer selected from the group consisting of poly [benzo(1,2-d:4,5-d')bisthiazole-2,6-diyl]-1,4-phenylene, its cis isomer, poly(p-phenylene benzobisimidazole), poly(p-phenylene benzobisoxazole), its trans isomer and mixtures thereof and a reaction medium selected from the group consisting of polyphosphoric acid, dehydrating phosphate acids, and mixtures thereof;

(b) polymerizing the reactants in the reaction mixture whereby a solution of said polymer is formed; and (c) forming shaped articles directly from the polymer solution.

2. The process of claim 1 wherein the reactants comprise from about 3 to about 20% by weight of the reaction mixture.

3. The process of claim 1 wherein polymerizing the reactants is performed at a temperature in the range of from about 150° to about 220° C. and at approximately atmospheric pressure.

4. The process of claim 3 wherein polymerizing the reactants is performed in a substantially inert atmosphere.

5. The process of claim 4 wherein the atmosphere is composed of nitrogen.

6. The process of claim 1 wherein the polymer comprises from about 5 to about 18% by weight of the solution and the article is formed by wet spinning into a coagulation bath or dry jet wet spinning into a coagulation bath.

7. The process of claim 6 wherein the coagulation bath is selected from the group consisting of water, aqueous phosphoric acid, methanol, and mixtures thereof.

8. The process of claim 7 wherein the shaped article is selected from the group consisting of fibers, filaments, yarns and films.

9. The process of claim 1 wherein the reaction medium is comprised of polyphosphoric acid and wherein polymerizing the reactants is performed at a temperature in the range of from about 170° to about 200° C. and a pressure in the range of from about 720 to about 800 mm.Hg.

10. The process of claim 9 wherein polymerizing the reactants is performed in a substantially inert atmosphere.

11. The process of claim 10 wherein the polymer is poly [benzo(1,2-d:4,5-d')bisthiazole-2,6-diyl]-1,4-phenylene, its cis isomer or mixtures thereof.

12. The process of claim 1 wherein the polymer has an intrinsic viscosity between about 10 and about 30 dl./g.

13. The process of claim 12 wherein the polymer has an intrinsic viscosity between about 20 and about 30 dl./g.

14. The process of claim 1 wherein the shaped article has a tenacity in the range of from about 3 to about 20 g./den.

15. The process of claim 1 wherein the shaped article has a modulus of from about 300 to about 1500 g./den.

* * * * *